US008146328B2

(12) United States Patent
Tsuruta et al.

(10) Patent No.: US 8,146,328 B2
(45) Date of Patent: Apr. 3, 2012

(54) FILM SUPPLY APPARATUS AND FILLING AND PACKAGING SYSTEM INCLUDING THE FILM SUPPLY APPARATUS

(75) Inventors: Orihiro Tsuruta, Takasaki (JP); Shunji Yamada, Takasaki (JP)

(73) Assignee: Orihiro Engineering Co., Ltd, Takasaki (JP)

( * ) Notice: Subject to any disclaimer, the term of this patent is extended or adjusted under 35 U.S.C. 154(b) by 264 days.

(21) Appl. No.: 12/522,898

(22) PCT Filed: Jan. 16, 2007

(86) PCT No.: PCT/JP2007/050510

§ 371 (c)(1),
(2), (4) Date: Jul. 10, 2009

(87) PCT Pub. No.: WO2008/087711

PCT Pub. Date: Jul. 24, 2008

(65) Prior Publication Data

US 2010/0043350 A1 Feb. 25, 2010

(51) Int. Cl.
*B65B 41/12* (2006.01)

(52) U.S. Cl. ..... 53/389.4; 53/168; 156/504; 242/555.3

(58) Field of Classification Search ..... 53/167, 53/168, 389.4; 156/504, 510; 242/551, 552, 242/553, 554.4, 555, 555.1, 555.2, 555.3
See application file for complete search history.

(56) References Cited

U.S. PATENT DOCUMENTS

| | | | | |
|---|---|---|---|---|
| 3,627,616 | A * | 12/1971 | Davis | 156/355 |
| 3,769,124 | A * | 10/1973 | Johnson | 156/159 |
| 4,219,378 | A | 8/1980 | Marschke | |
| 5,411,223 | A * | 5/1995 | Gatteschi | 242/551 |
| 5,692,698 | A * | 12/1997 | Forbes | 242/533.4 |
| 6,142,408 | A * | 11/2000 | Focke et al. | 242/553 |
| 6,192,955 | B1 * | 2/2001 | Rice | 156/351 |
| 6,886,772 | B2 * | 5/2005 | Hirata et al. | 242/554.2 |
| 7,147,737 | B2 * | 12/2006 | Rassl et al. | 156/159 |
| 7,426,809 | B2 * | 9/2008 | Arima | 53/64 |
| 2006/0026926 | A1 | 2/2006 | von Triel et al. | |

FOREIGN PATENT DOCUMENTS

EP 0780331 A2 6/1997

(Continued)

OTHER PUBLICATIONS

International Preliminary Report on Patentability for PCT/JP2007/050510, Filing Date Jan. 16, 2007.

(Continued)

*Primary Examiner* — Thanh Truong
(74) *Attorney, Agent, or Firm* — Knobbe Martens Olson & Bear LLP

(57) ABSTRACT

Film supply apparatus (2) has two film holders (22*a*, 22*b*) supporting two rolls of film as film (101) on a use side and film (100) on a stand-by side respectively, feed rollers (3) for feeding film (101) on the use side, film holding member (34) holding a leading end portion of film (100) on the stand-by side, sucker (36) pulling back film (100) on the stand-by side upstream in a feeding direction and heater bar (31) heat-sealing two films (100, 101). Sucker (36) attracts film (100) by suctioning and pulls film (100) back to a position where a leading end portion thereof faces heater bar (31).

16 Claims, 11 Drawing Sheets

FOREIGN PATENT DOCUMENTS

| | | | |
|---|---|---|---|
| JP | A-S63-55027 | | 3/1988 |
| JP | 2003-166164 | A | 6/2003 |
| JP | A-2003-166164 | | 6/2003 |
| JP | 2005-082201 | A | 3/2005 |
| JP | 2005-145559 | A | 6/2005 |
| JP | 2005-516858 | A | 6/2005 |
| JP | A-2005-145559 | | 6/2005 |
| JP | A-2005-272125 | | 10/2005 |
| JP | A-2005-280927 | | 10/2005 |
| JP | 2006-256674 | A | 9/2006 |
| JP | A-2006-256674 | | 9/2006 |
| WO | 03/066444 | A1 | 8/2003 |

OTHER PUBLICATIONS

Office Action dated Dec. 6, 2010 in corresponding Chinese Application No. 200780052176.

Korean Office Action dated Jun. 28, 2011 with English translation.

EP 07706537 Extended European Search Report dated Sep. 5, 2011.

EP 07706837 Extended European Search Report dated May 9, 2011.

* cited by examiner

[Fig. 1]
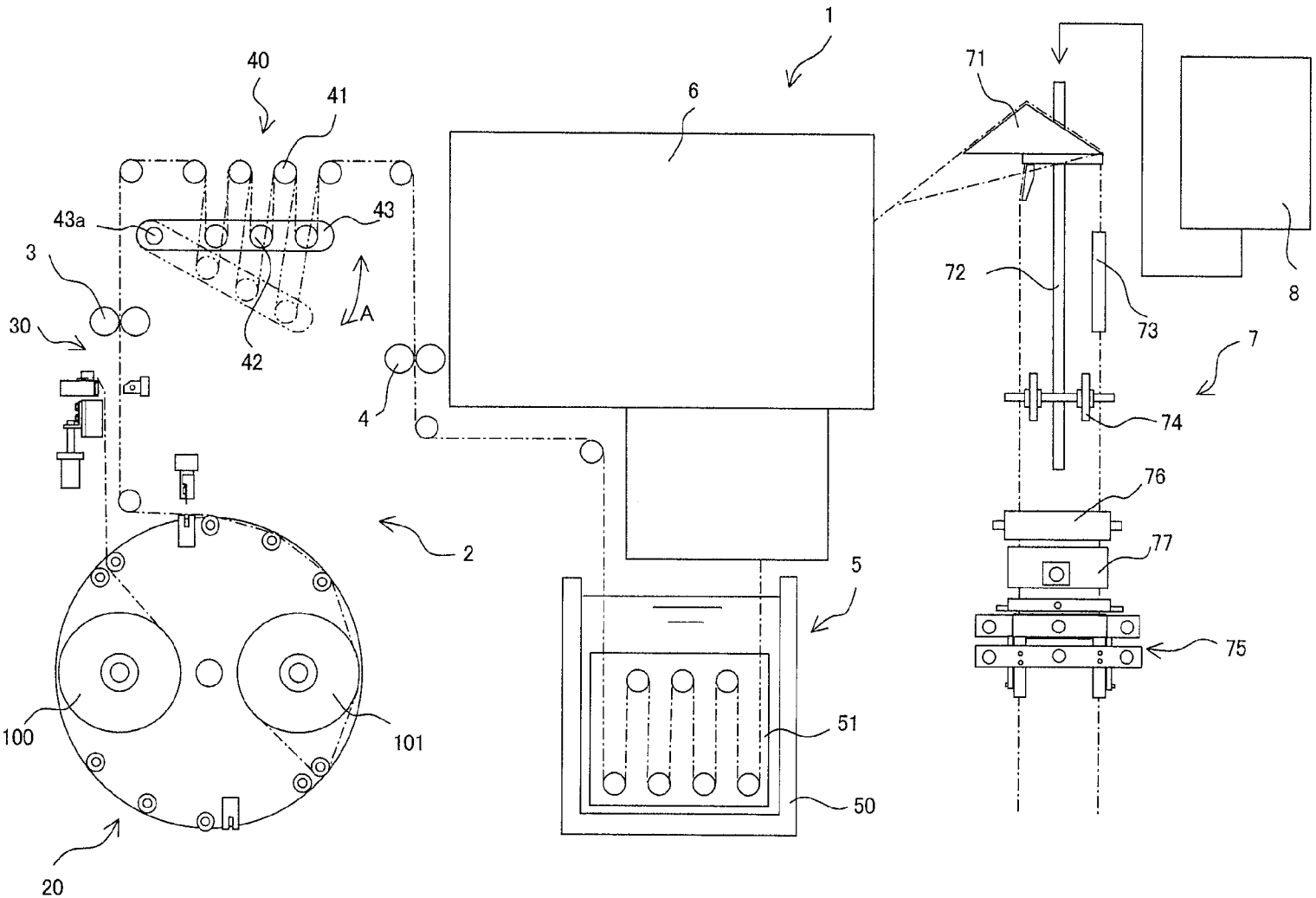

[Fig. 2]
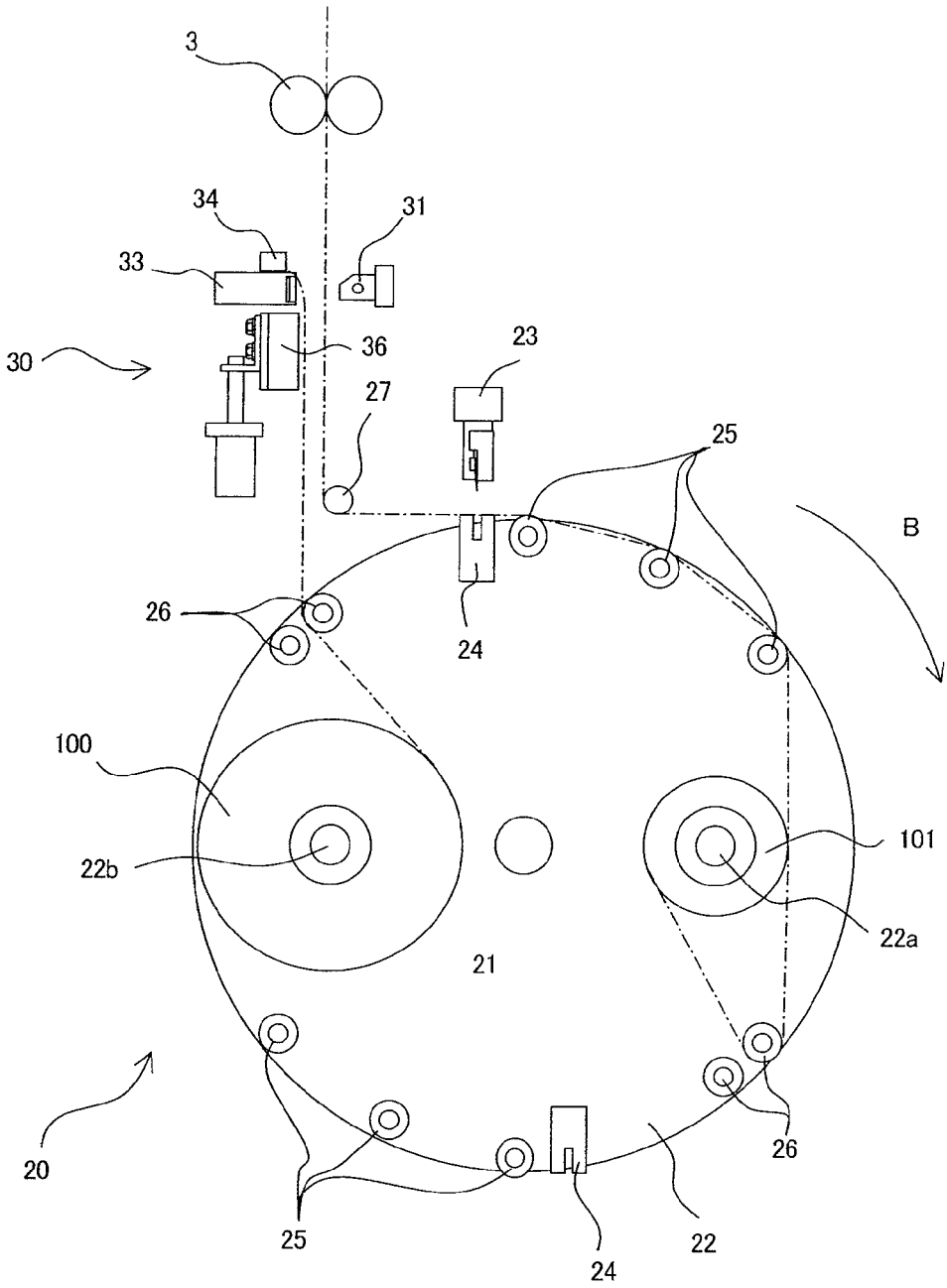

[Fig. 3]
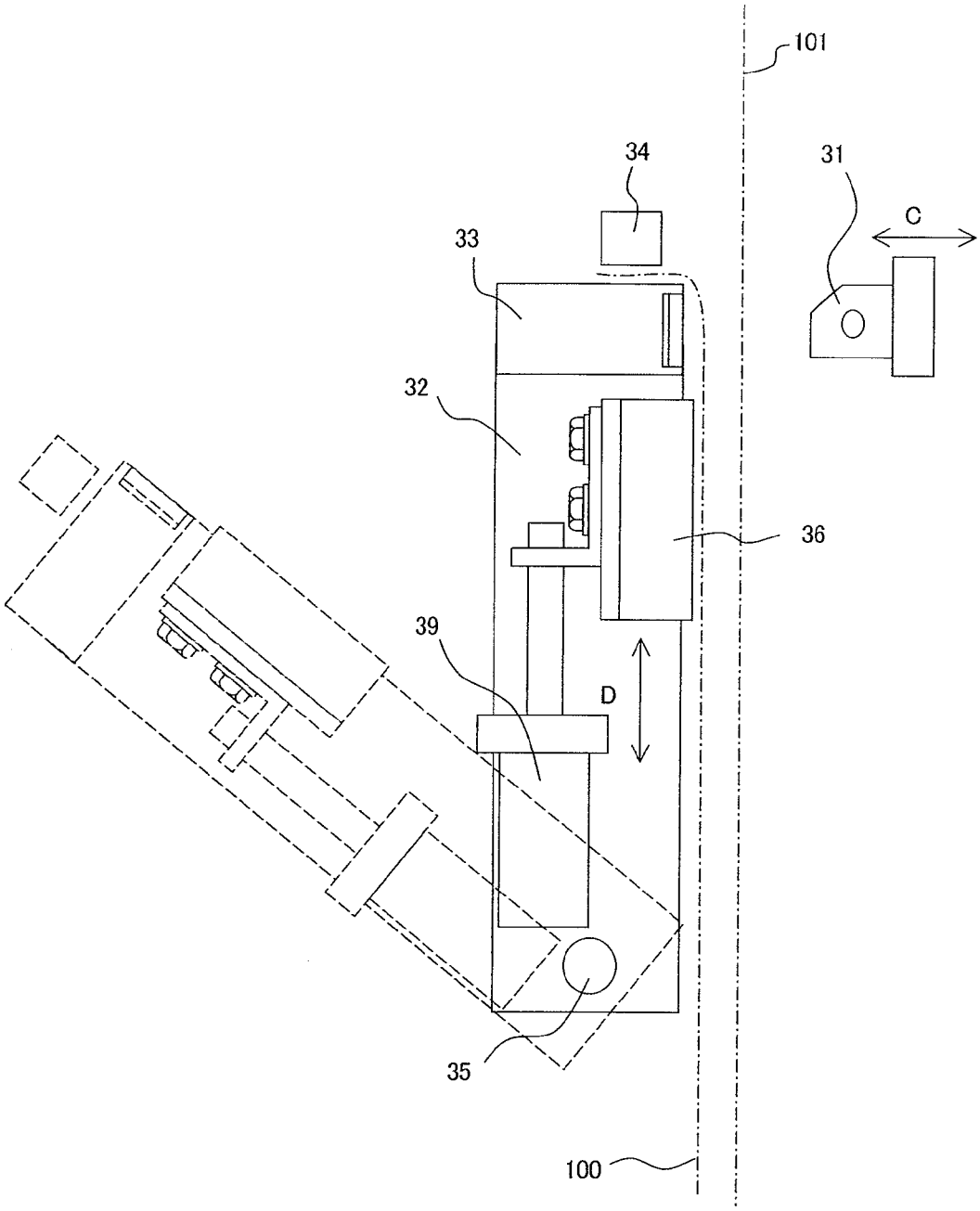

[Fig. 4A]
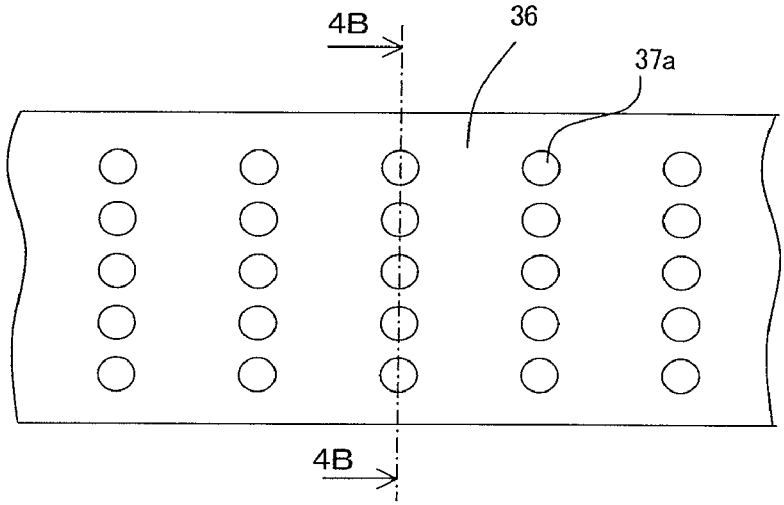
[Fig. 4B]
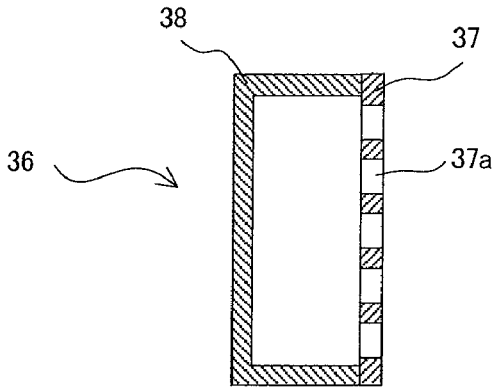

[Fig. 5A]
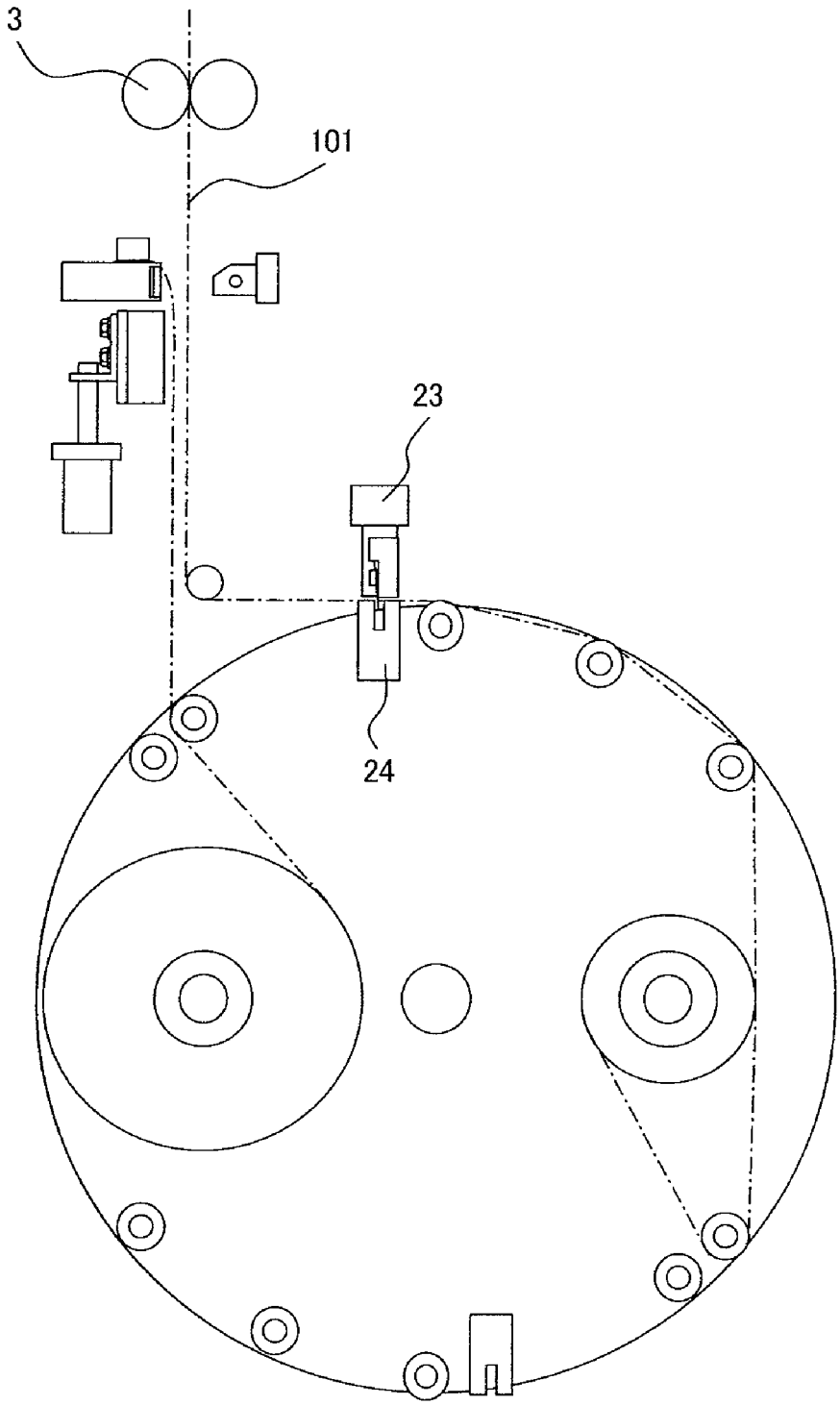

[Fig. 5B]
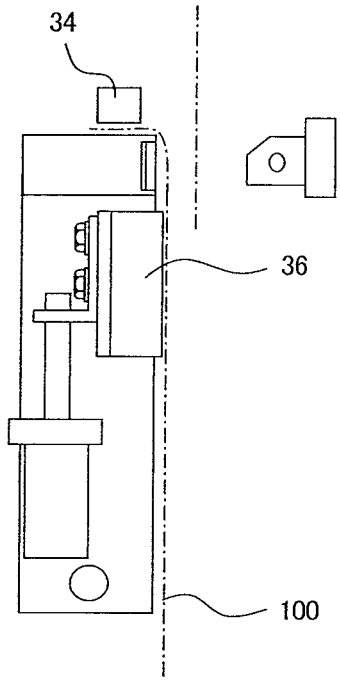
[Fig. 5C]
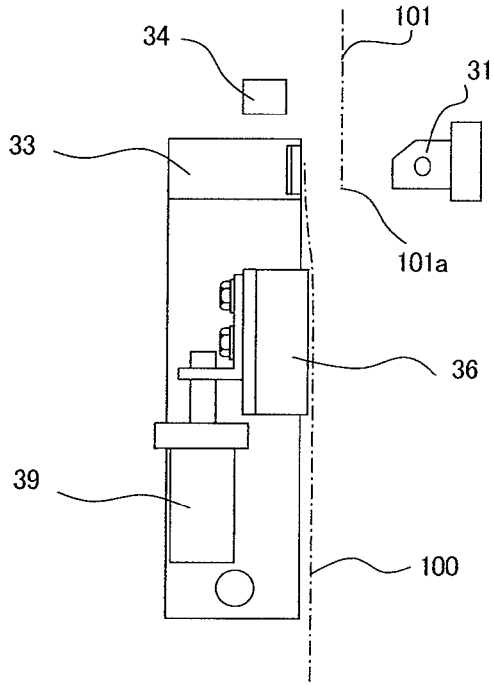

[Fig. 5D]
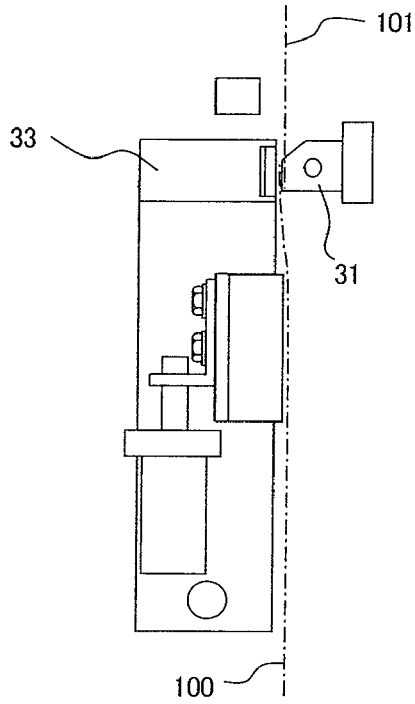
[Fig. 5E]
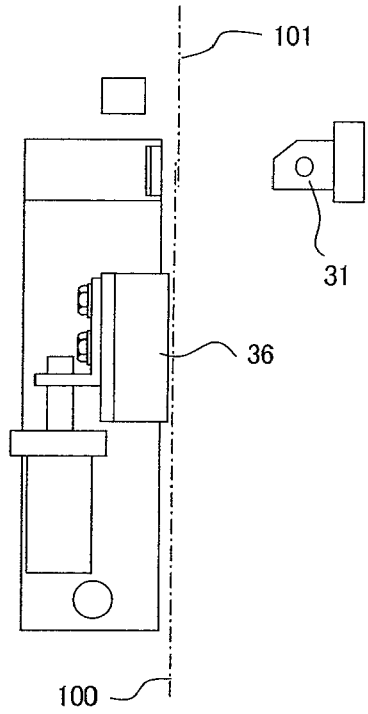

[Fig. 5F]
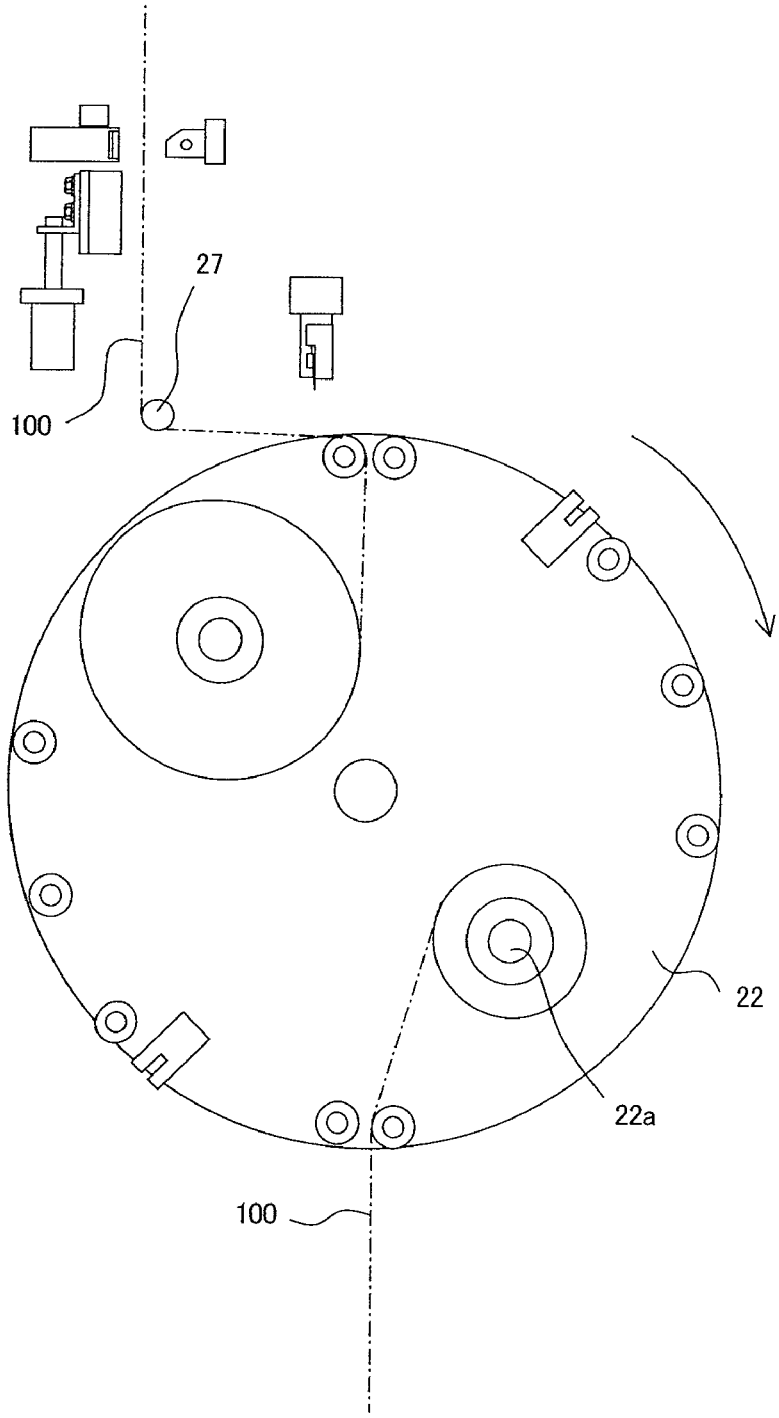

[Fig. 5G]
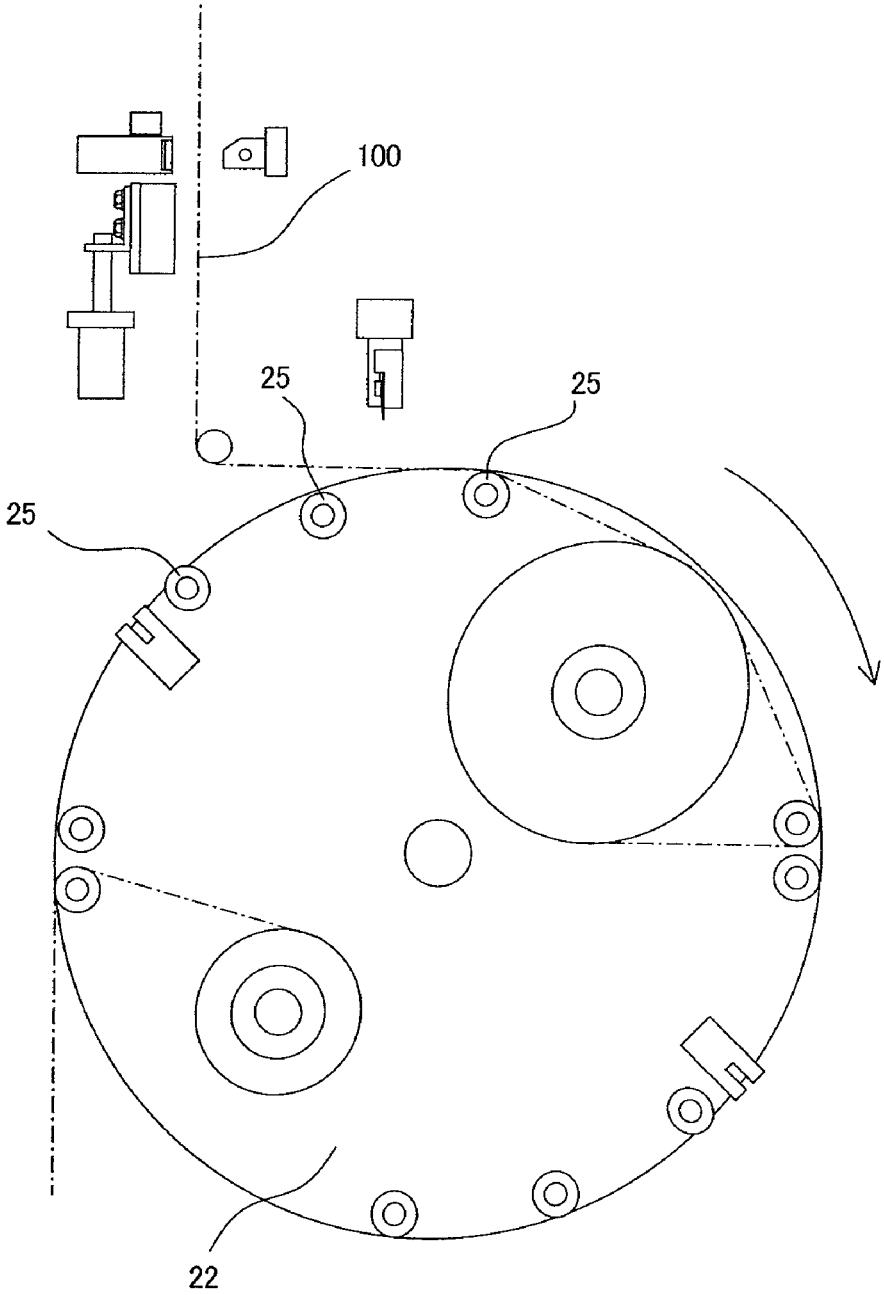

[Fig. 5H]
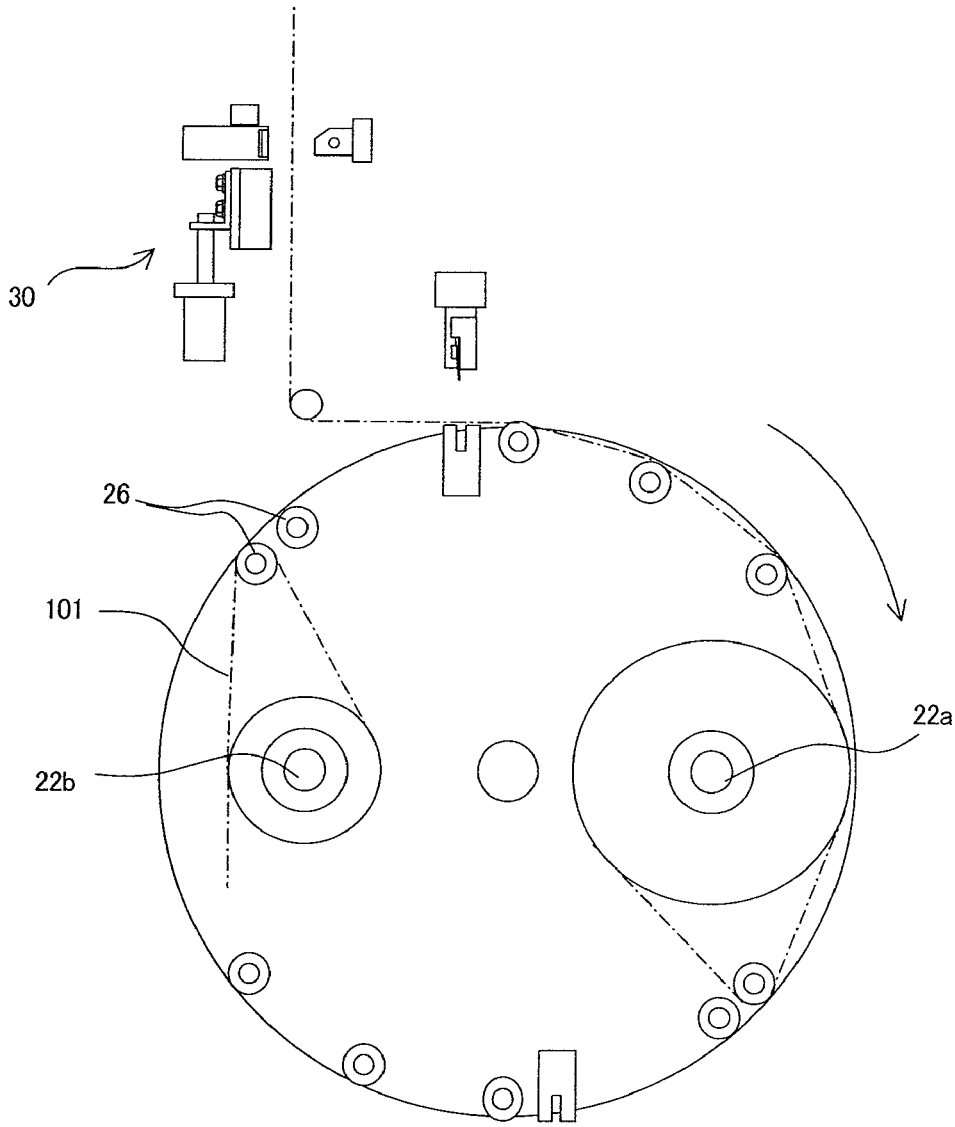

[Fig. 6]
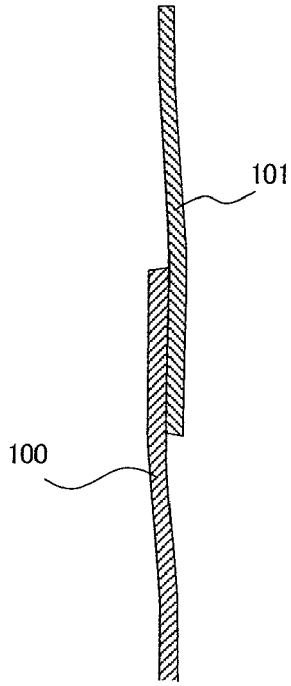
[Fig. 7]
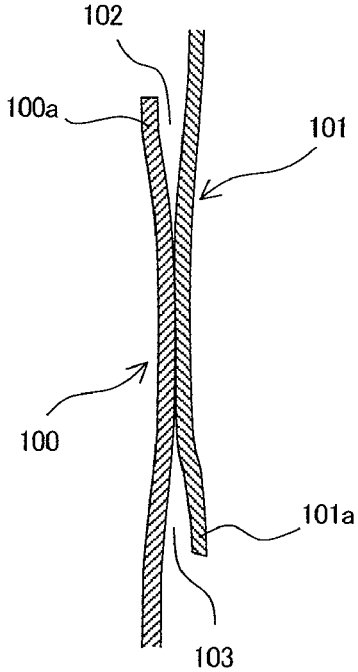

FILM SUPPLY APPARATUS AND FILLING AND PACKAGING SYSTEM INCLUDING THE FILM SUPPLY APPARATUS

This application is the U.S. National Phase under 35 U.S.C. 371 of International Application PCT/JP2007/050510, filed Jan. 16, 2007. The International Application was published under PCT Article 21(2) in a language other than English.

TECHNICAL FIELD

The present invention relates to a film supply apparatus which unwinds a roll of film to supply the film to a packaging machine without interruption in order to achieve the continuous supply of the film in the packaging machine, and to a packaging system including the film supply apparatus.

BACKGROUND ART

Filling and packaging systems are used to continuously produce packages having contents such as a liquid and a viscous object held in film. A typical filling and packaging system has a film supply apparatus which supplies a continuous sheet of film, a content supply apparatus which supplies contents, and a filling and packaging machine which fills the contents supplied from the content supply apparatus into the film as the machine shapes the film supplied from the film supply apparatus into a bag.

Specifically, in an aseptic packaging system, a film sterilizing apparatus is placed between a film supply apparatus and a filling and packaging machine, and a sterilizing apparatus is also provided for a content supply apparatus. In the film sterilizing apparatus, a hydrogen peroxide solution is often used as a sterilization liquid. Film unwound from the film supply apparatus is immersed in the sterilization liquid, the sterilization liquid is dried, and then the film is supplied to the filling and packaging machine.

A roll of film is set in the film supply apparatus, and the set film is unwound and supplied to the packaging machine. After the set film is used up, it is switched to a next film. To avoid an interruption of the operation of the packaging machine during the switching, a conventional film supply apparatus is configured such that the next film is stood by, and when the film on the use side nears a trailing end, the trailing end portion of the film on the use side is bonded to a leading end portion of the film stood by.

For example, each of Japanese Patent Laid-Open No. 2005-272125 (Patent Document 1) and Japanese Patent Laid-Open No. 2005-280927 (Patent Document 2) has disclosed a film supply apparatus which has two film holders each rotatably holding a roll of film, a film holding mechanism which holds a leading edge portion of the film on a stand-by side, and a seal mechanism which heat-seals the film on a use side and the film on the stand-by side throughout the width thereof. The film holding mechanism holds the film on the stand-by side by clamping a leading end portion thereof such that the film on the stand-by side is drawn out to face the film on the use side on a feeding path of the film on the use side. The seal mechanism is placed upstream of the held portion of the film on the stand-by side in a feeding direction of the film.

When the trailing end of the film on the use side is fed to a predetermined position corresponding to the position of the seal mechanism, the feeding of the film is stopped and the seal mechanism is driven. The driving of the seal mechanism causes the film on the use side and the film on the stand-by side to be heat-sealed, and at the same time, the leading end portion of the film on the stand-by side is released from the clamping by the film holding mechanism. Then, the feeding of the film is restarted, and the film originally placed on the stand-by side is supplied to the packaging machine as the film on the use side at this point in time. A film accumulation mechanism can be placed between the film supply apparatus and the packaging machine to realize the bonding of the films without stopping the operation of the packaging machine.

In the abovementioned conventional film supply apparatus, the film on the stand-by side is bonded to the film on the use side while the leading end portion of the former film remains clamped. Thus, as shown in FIG. 7 which is a section view of the bonded portions of the films, clamped leading end portion 100*a* of film 100 on the stand-by side is a non-fused portion which simply overlies film 101 on the use side. As a result, gap 102 is produced between leading end portion 100*a* of film 100 on the stand-by side and film 101 on the use side.

In trailing end portion 101*a* of film 101 on the use side, gap 103 may also be produced between films 100 and 101. Gap 103, however, can be prevented by appropriately controlling the feeding length of film 101 on the use side. On the other hand, the gap at leading end portion 100*a* of film 100 on the stand-by side is inevitably present as long as films 100 and 101 are heat-sealed while leading end portion 100*a* remains clamped.

When a packaging bag is produced with gap 102 present in this manner, gap 102 may be placed inside or outside the packaging bag depending on the relationship of the positions between films 100 and 101. If gap 102 is placed inside the packaging bag, the contents may fall into gap 102. If gap 102 is placed outside the packaging bag, a foreign matter may fall into gap 102.

If the conventional film supply apparatus is used in the aseptic packaging system, the sterilization liquid enters gap 102 when the bonded portion of films is immersed in the sterilization liquid. The sterilization liquid which entered gap 102 may stay there even after a dry step. Thus, if gap 102 is placed inside the packaging bag, the sterilization liquid staying in gap 102 may be incorporated into the packaging bag. If gap 102 is present outside the packaging bag, the sterilization liquid may drop in a film transfer process to adhere to another portion of the film. Especially when the sterilization liquid drops to a part which corresponds to the inner surface of the packaging bag, the sterilization liquid enters the packaging bag as a result.

DISCLOSURE OF THE INVENTION

It is an object of the present invention to provide a film supply apparatus which allows bonding of films with no gap present at end portions in the bonded portion of the films, and an aseptic filling and packaging system.

A film supply apparatus according to the present invention includes two film holders supporting two rolls of film as a film on a use side and a film on a stand-by side, respectively, a feed roller for feeding the film on the use side, a film holding member holding a leading end portion of the film on the stand-by side, a film returning mechanism pulling back the film on the stand-by side upstream in a feeding direction of the film, and a fusion bonding mechanism heat-sealing the film on the use side and the film on the stand-by side. The film holding member releasably holds the leading end portion of the film on the stand-by side in the upper stream of the feed roller in the feeding direction of the film such that the film on the stand-by side is drawn out to face the film on the use side. The film returning mechanism is placed upstream of the film holding member in the feeding direction of the film and pulls back the film on the stand-by side in a state in which the film returning mechanism holds the film on the stand-by side in the upper stream of a part held by the film holding member. The fusion bonding mechanism is placed between the film holding member and the film returning mechanism in the feeding direction of the film and heat-seals the two opposite films throughout the width thereof.

In the film supply apparatus structured as described above, a trailing end portion of the film on the use side and the film on the stand-by side are heat-sealed to bond them, which enables continuous supply of the film. A leading end portion of the film on the stand-by side is held by the film holding member. For heat sealing with the film on the use side, the film on the stand-by side is pulled back by the film returning mechanism in a state in which the film is released from the holding by the film holding member. The pull-back length of the film on the stand-by side and the feed length of the film on the use side are appropriately set to allow the heat sealing of the whole overlap area of the film on the use side and the film on the stand-by side.

The film supply apparatus according to the present invention may further include a cutter placed upstream of the fusion bonding mechanism in the feeding direction of the film and cutting the film on the use side throughout the width thereof. This can bond the film on the use side to the film on the stand-by side at an arbitrary position.

The film holder holders may be supported by a rotator which is rotated 180 degrees to switch the relationship between the two film holders after the heat sealing of the film by the fusion bonding mechanism.

The fusion bonding mechanism may be formed to have a heater bar containing an electric heater and a heater bar receiver cooperating with the heater bar to pressurize and heat the film. In this case, the fusion bonding mechanism is driven to heat-seal the films on the use side and the stand-by side with the heater bar and the heater bar receiver in a state in which the leading end portion of the film on the stand-by side released from the holding by the film holding member is pulled back by the film returning mechanism to be placed in an area pressurized by the heater bar and the heater bar receiver and the trailing end portion of the film on the use side is fed by the feed roller to overlie the film on the stand-by side in the area pressurized by the heater bar and the heater bar receiver.

A filling and packaging system according to the present invention includes a film supply part including the film supply apparatus according to the present invention described above, a content supply part supplying contents, and a filling and packaging part sealing the contents supplied from the content supply part into the film while the filling and packaging part shapes the film supplied from the film supply part into a bag.

The filling and packaging system according to the present invention is more effective particularly when the system further includes a sterilizing part sterilizing the film supplied from the film supply part by immersing the film in a sterilization liquid, and a dry part drying the sterilization liquid adhering to the film in the sterilizing part and supplying the film to the filling and packaging part.

As described above, according to the present invention, since the whole overlap area of the film on the use side and the film on the stand-by side can be heat-sealed, it is possible to prevent effectively a gap which may result in entry of a foreign matter or introduction of a sterilization liquid. Especially when the present invention is applied to an aseptic filling and packaging system, the possibility of the sterilizing liquid remaining in a package can be significantly reduced by effectively preventing the sterilization liquid from entering between the film on the use side and the film on the stand-by side.

BRIEF DESCRIPTION OF THE DRAWINGS

FIG. 1 is a diagram showing the structure of an aseptic filling and packaging system according to an embodiment of the present invention.

FIG. 2 is a front view showing a film switching mechanism and a film fusion bonding mechanism shown in FIG. 1

FIG. 3 is an enlarged view showing the film fusion bonding mechanism shown in FIG. 2.

FIG. 4A is a front view partially showing a sucker shown in FIG. 2.

FIG. 4B is a section view taken along line 4B-4B in FIG. 4A.

FIG. 5A is a front view of the film switching mechanism and the film fusion bonding mechanism to explain switching operation of films in a film supply apparatus shown in FIG. 1, in which a step of cutting a film on a use side is shown.

FIG. 5B is a front view of the film fusion bonding mechanism to show a step of attracting a film on a stand-by side performed following the step in FIG. 5A.

FIG. 5C is a front view of the film fusion bonding mechanism to show a step of pulling back the attracted film on the stand-by side performed following the step in FIG. 5B.

FIG. 5D is a front view of the film fusion bonding mechanism to show a step of heat-sealing the film on the stand-by side and the film on the use side performed following the step in FIG. 5C.

FIG. 5E is a front view of the film fusion bonding mechanism after the bonding of the film on the stand-by side to the film on the use-side.

FIG. 5F is a diagram for explaining the operation of the film switching mechanism after the bonding of the film on the stand-by side to the film on the use-side.

FIG. 5G is a diagram for explaining the operation of the film switching mechanism after the bonding of the film on the stand-by side to the film on the use-side, which shows a rotator rotated with respect to the state shown in FIG. 5F.

FIG. 5H is a diagram for explaining the operation of the film switching mechanism after the bonding of the film on the stand-by side to the film on the use-side, which shows the rotator rotated 180 degrees with respect to the state shown in FIG. 5A.

FIG. 6 is a section view showing the films bonded by the film fusion bonding mechanism shown in FIG. 3.

FIG. 7 is a section view showing films bonded by a conventional film fusion bonding mechanism.

DESCRIPTION OF REFERENCE NUMERALS

1 ASEPTIC FILLING AND PACKAGING SYSTEM
2 FILM SUPPLY APPARATUS
3, 4 FEED ROLLERS
5 STERILIZING APPARATUS
6 DRY APPARATUS
7 FILLING AND PACKAGING MACHINE
8 CONTENT SUPPLY APPARATUS
20 FILM SWITCHING MECHANISM
22 ROTATOR
22*a*, 22*b* FILM HOLDERS
23 CUTTER UNIT
30 FILM FUSION BONDING MECHANISM
31 HEATER BAR
33 HEATER BAR RECEIVER

34 FILM HOLDING MEMBER
36 SUCKER
40 ACCUMULATION MECHANISM
100, 101 FILMS

BEST MODE FOR CARRYING THE INVENTION

As shown in FIG. 1, aseptic filling and packaging machine 1 according to an embodiment of the present invention has film supply apparatus 2, sterilizing apparatus 5 which sterilizes film 101 supplied from film supply apparatus 2 with a sterilization liquid, dry apparatus 6 which dries the sterilization liquid attaching to film 101 in the sterilization by sterilizing apparatus 5, content supply apparatus 8, and filling and packaging machine 7 which seals contents supplied from content supply apparatus 8 in film 101 while shaping film 101 into a bag after the sterilization liquid on film 101 is dried by dry apparatus 6.

Film supply apparatus 2 holds a roll of film 101 and supplies film 101 continuously to filling and packaging machine 7 by unwinding and feeding film 101. Film supply apparatus 2 holds another roll of film 100 stood by. When film 101 on a use side nears a trailing end, film supply apparatus 2 bonds film 100 on a stand-by side to film 101 on the use side to avoid an interruption of supply of films 100 and 101 to filling and packaging machine 7.

Film supply apparatus 2 has film switching mechanism 20 for switching a film to be supplied, film fusion bonding mechanism 30 for bonding film 101 on the use side and film 100 on the stand-by side, and accumulation mechanism 40 for allowing supply of film 101 during a stop of feeding of film 101 by the operations of film switching mechanism 20 and film fusion bonding mechanism 30.

Accumulation mechanism 40 has a plurality of guide rollers 41 placed on a traveling path of film 101, and a plurality of accumulation rollers 42 supported by lever 43. Film 101 is run alternately on guide rollers 41 and accumulation rollers 42 to route film 101 serpentinely. Lever 43 is swingably supported about shaft 43*a* as shown by arrow A. The swing of lever 43 changes the length of the path of film 101. Even while the feeding of film 101 is stopped during the bonding of films 100 and 101 and the like, film 101 stored in accumulation mechanism 40 can be fed out and supplied to filling and packaging machine 7.

Feed rollers 4 are placed downstream of accumulation mechanism 40 in the supply direction of film 101 to feed film 101 supplied from film supply apparatus 2 to filling and packaging machine 7. Although not shown, another feed roller may be placed on the traveling path of the film from film supply apparatus 2 to filling and packaging machine 7.

Next, film switching mechanism 20 and film fusion bonding mechanism 30 will be described with reference to FIGS. 2 and 3.

Film switching mechanism 20 has rotator 22 of disc shape which supports elements constituting film switching mechanism 20. Rotator 22 is fixed to major shaft 21 rotating about a horizontal axis and rotates in a direction shown by arrow B in response to the rotation of main shaft 21 by a motor, not shown.

Two film holders 22*a* and 22*b* extending parallel to main shaft 21 are attached to rotator 22. Film holders 22*a* and 22*b* are placed at positions which are point symmetric with respect to the rotation center of rotator 22. Holders 22*a* and 22*b* removably hold rolls of film 101 and 100 rotatably relative to rotator 22, respectively.

During normal operation of aseptic filling and packaging machine 1 (see FIG. 1), that is, during normal supply operation in which film supply apparatus 2 supplies film 101, rotator 22 is stopped such that film holders 22*a* and 22*b* are placed side by side in a horizontal direction as shown in FIG. 2.

Pairs of drawing rollers 26 and a plurality of guide rollers 25 are placed on the outer periphery of rotator 22. Pairs of drawing rollers 26 are provided for drawing films 100 and 101 placed on film holders 22*b* and 22*a* to the outer periphery of rotator 22. Guide rollers 25 are placed along the circumferential direction of rotator 22 and guide films 100 and 101 drawn to the outer periphery of rotator 22 in a direction opposite to the rotation direction of rotator 22 along the outer periphery of rotator, 22.

A film end tape (not shown) is attached at a trailing end portion of each of films 100 and 101. Film switching mechanism 20 has a film end sensor (not shown) which detects the film end tape on the traveling path of each of films 100 and 101 through guide rollers 25 and drawing rollers 26. An optical sensor which optically detects the film end tape can be preferably used as the film end sensor.

Rotator 22 is also operated at the position rotated 180 degrees with respect to the position shown in FIG. 2. Thus, drawing roller pairs 26, guide rollers 25, and the film end sensors are separated into two sets associated with films 100 and 101, respectively, and the sets are placed at positions which are point symmetric with respect to the rotation center of rotator 22.

The placement of drawing roller pairs 26 and guide rollers 25 as described above allows film 101 supported by film holder 22*a* to be drawn out via drawing roller pair 26, guided by guide rollers 25, and led to film fusion bonding mechanism 30. On the other hand, film 100 supported by film holder 22*b* is drawn out only via the other drawing roller pair 26 and led to film fusion bonding mechanism 30. At this sutate, film 100 is not guided by guide rollers 25.

Film fusion bonding mechanism 30 is placed above film switching mechanism 20. Films 100 and 101 are led to film fusion bonding mechanism 30 with the films opposed in parallel substantially in a vertical plane. Thus, guide roller 27 is also placed on the traveling path of the film from film switching mechanism 20 to film fusion bonding mechanism 30. Feed rollers 3 driven by a motor, not shown, are placed above film fusion bonding mechanism 30 to feed film 101 led via guide roller 27 upward to supply film 101 to accumulation mechanism 40. Feed rollers 3 are driven independently of feed rollers 4 placed downstream of accumulation mechanism 40.

Film 101 guided by guide rollers 25 and being led to film fusion bonding mechanism 30 is cut along a width direction of film 101 after the film end tape of film 101 is detected or as required. Film switching mechanism 20 has cutting means for cutting film 101. The cutting means includes cutter unit 23 and cutter receiver 24 which sandwiches film 101 between cutter receiver 24 and cutter unit 23 in the cutting of film 101.

Cutter unit 23 is mounted to be movable forward or backward such that its cutting edge is moved into the traveling path of film 101. Cutter receiver 24 is placed on the outer periphery of rotator 22 at a position opposite to cutter unit 23 during the supply operation of film supply apparatus 2. As described above, since rotator 22 is also operated at the position rotated 180 degrees, another cutter receiver 24 is placed at such a position that these cutter receivers 24 are point symmetric with respect to the rotation center of rotator 22. Cutter receiver 24 has a recessed portion formed in a surface opposite to cutter unit 23 for receiving the cutting edge of cutter unit 23.

The film end sensors described above are placed upstream of cutter receivers 24 on the traveling direction of film 101 in film switching mechanism 20.

The abovementioned example has been described that rotator 22 has disc shape. However, the shape of rotator 22 is not limited thereto. Rotator 22 can have an arbitrary shape as long as film holders 22*a* and 22*b*, film drawing roller pairs 26, guide rollers 25, and cutter receivers 24 can be placed at the abovementioned positions. For example, rotator 22 can be reduced in weight by notching or hollowing rotator 22 to the extent that the placement of the components is not obstructed. The reduction in weight of rotator 22 is advantageous since the load on a driving source for driving rotator 22 can be reduced.

Next, film fusion bonding mechanism 30 will be described in detail.

Film fusion bonding mechanism 30 has heater bar 31 which contains an electric heater (not shown), and heater bar receiver 33 placed opposite to heater bar 31. Film 101, after passing guide roller 27, is fed between heater bar 31 and heater bar receiver 33. Heater bar 31 reciprocates in a direction shown by arrow C (see FIG. 3) to pressurize heater bar receiver 33 or move away from heater bar receiver 33. Heater bar 31 and heater bar receiver 33 are formed such that they cooperate to allow pressurization and heating of film 101 throughout the width thereof.

As shown in FIG. 3, heater bar receiver 33 is supported, at both end portions thereof along the width direction of the film, by support member 32. Support member 32 extends along the feeding direction of film 101 between heater bar receiver 33 and heater bar 31 and supports heater bar receiver 33 at a downstream end portion (top end portion in the embodiment) in the feeding direction of the film. Support shaft 35 is placed at an upstream end portion (bottom end portion in the embodiment) of support member 32 in the feeding direction of the film. Support member 32 is rotatable to a predetermined angle about support shaft 35 to tilt such that heater bar receiver 33 is moved away from heater bar 31 as shown by broken lines in FIG. 3.

Film holding member 34 is placed downstream of the area where heater bar receiver 33 is pressurized by heater bar 31 in the feeding direction of film 101. Film holding member 34 is attached to heater bar receiver 33 to be movable toward or away from heater bar receiver 33 and presses a leading end portion of film 100, directly led to film fusion bonding mechanism 30 via film drawing rollers 26, against heater bar receiver 33. This holds the leading end portion of film 100. In the embodiment, film holding member 34 is placed on a top surface of heater bar receiver 33.

Film 100 is held by film holding member 34 in this manner to cause two films 100 and 101 placed on film switching mechanism 20 to be present one on another between heat bar receiver 33 and heater bar 31. In this state, heater bar 31 is moved toward heater bar receiver 33 and film 101 is pressurized and heated by heater bar 31 and heater bar receiver 33 to heat-seal films 100 and 101 throughout the width thereof Upstream of heater bar receiver 33 in the feeding direction of film 101, sucker 36 is placed to attract film 100 held by film holding member 34 in the upper stream of the region of film 100 held by film holding member 34. Sucker 36 has a hollow structure and has a plurality of openings 37*a* formed in a surface thereof opposite to film 100 as shown in FIG. 4A. Sucker 36 can be formed to include body 38 which has an opened side and lid member 37 which covers the opened side of body 38 as shown in FIG. 4B, for example. Openings 37*a* are formed in lid member 37.

Air is exhausted from sucker 36 by a pump, not shown, so that air around the surface having openings 37*a* formed therein is sucked into sucker 36 through openings 37*a*. Sucker 36 attracts to hold film 100 through the suction of the air.

A pressure sensor (not shown) is preferably provided within sucker 36. When film 100 is attracted by sucker 36, openings 37*a* are covered with film 100. The attraction of film 100 simultaneous with the exhaustion of the air from sucker 36 causes a sudden change in the internal pressure of sucker 36 after the attracting as compared with that before the attracting. The change in the pressure can be detected by the pressure sensor to detect the attraction of film 100.

As shown in FIG. 3, sucker 36 is supported by support member 32 to be freely reciprocated in a direction shown by arrow D parallel to the feeding direction of film 101. A rod of cylinder 39 fixed to support member 32 is fixed to sucker 36 via a bracket. Thus, cylinder 39 can be driven to move sucker 36 in the direction of arrow D.

Referring again to FIG. 1, the remaining structure of aseptic filling and packaging machine 1 will be described.

Sterilizing apparatus 5 sterilizes film 101 supplied from film supply apparatus 2. A hydrogen peroxide solution is used as the sterilizing liquid in this embodiment. The hydrogen peroxide solution is filled in sterilizing tank 50. Film routing unit 51 is adapted to be freely put into or out of sterilizing tank 50. Film routing unit 51 has a plurality of rollers placed in a staggered arrangement. Film 101 is run on these rollers to route film 101 serpentinely.

When aseptic filling and packaging machine 1 is operated while film routing unit 51 is placed within sterilizing tank 50 filled with the hydrogen peroxide solution, film 101 is immersed in the hydrogen peroxide solution during the feeding of film 101. Film 101 is sterilized thereby.

Dry apparatus 6 dries the hydrogen peroxide solution attaching to film 101 in the passage of film 101 through sterilizing apparatus 5 by blowing hot air or the like.

Content supply apparatus 8 prepares as required contents to be filled into a packaging bag and supplies the contents to filling and packaging machine 7. The contents are sterilized by heating before supply to filling and packaging machine 7. Content supply apparatus 8 includes a sterilizing apparatus therefor.

Filling and packaging machine 7 produces the packaging bag by using sterilized film 101 after the passage through sterilizing apparatus 5 and dry apparatus 6 and the sterilized contents supplied from content supply apparatus 8. Filling and packaging machine 7 can be used a typical filling and packaging machine which has at least bag forming guide 71, supply pipe 72, vertical seal mechanism 73, and horizontal seal mechanism 75.

Bag forming guide 71 guides film 101 downward while forming film 101 by folding film 101 in half along its longitudinal direction to align both edges thereof while guide 71 after the passage through dry apparatus 6. Auxiliary feed roller 74 is placed under bag forming guide 71 to assist the feeding of film 1 from upward to downward.

Vertical seal mechanism 73 is placed between bag forming guide 71 and auxiliary feed roller 74. Vertical seal mechanism 73 has a pair of vertical seal bars disposed opposite to each other across a path through which the aligned edges of film 101 formed by bag forming guide 71 pass. At least one of the paired vertical seal bars contains a heating means (not shown) such as an electric heater. The vertical seal bars are driven to pressurize and heat the opposite edges of film 101 intermittently at regular time intervals in synchronization with the feeding of film 101. Thus, the edges of formed film 101 are heat-sealed throughout the longitudinal direction of film 101 to shape film 101 into a tubular shape.

Supply pipe 72 is placed for introducing contents supplied from content supply apparatus 8 into film 101 shaped in the tube through the heat sealing by vertical seal mechanism 73.

Horizontal seal mechanism 75 has a pair of horizontal seal bars placed opposite to each other with film 101 interposed therebetween under supply pipe 72, and heat-seals film 101 along the width direction and throughout the width. The horizontal seal bars are driven intermittently at regular time intervals in synchronization with the feeding of film 101 to form horizontal seal portions throughout the width of film 101 at regular space intervals in the longitudinal direction of film 101. As a result, the contents introduced into film 101 are sealed in.

The portion of film, 101 that is defined by two vertically adjacent horizontal seal portions represents a single package unit. Horizontal seal mechanism 75 may also include a cutter (not shown) for cutting film 101 in the horizontal seal portion along the width direction. Film 101 is cut by the cutter for each of horizontal seal portions to obtain packages separated in the individual packages units. The cutter may be contained in one of the pair of horizontal seal bars or may be formed as a unit independent of the horizontal seal bars.

Filling and packaging machine 7 preferably has a pair of squeeze rollers 76 and a pair of shaping plates 77 in addition to the above-mentioned components.

The pair of squeeze rollers 76 are placed opposite to each other with the passage path of film 101 interposed therebetween under supply pipe 72. Squeeze rollers 76 are adapted to rotate in a direction for feeding film 101 downward and to be movable opposite such that rollers 76 are opened or closed. Squeeze rollers 76 have such a length as to pressurize film 101 throughout the width thereof when rollers 76 are closed.

While the contents are introduced at a level above squeeze rollers 76, squeeze rollers 76 are closed. The pressurization force of squeeze rollers 76 squeezes film 101 to separate the contents into two portions above and below rollers 76. While squeeze rollers 76 are held closed, they are rotated. The contents above squeeze rollers 76 remain above squeeze rollers 76, and only the contents below squeeze rollers 76 are fed together with film 101 as film 101 is squeezed by squeeze rollers 76. The portion of film 101 squeezed by squeeze rollers 76 can be heat-sealed by horizontal seal mechanism 75 to produce a package without mixing of air.

A pair of shaping plates 77 are placed opposite to each other across film 101 between squeeze rollers 76 and horizontal seal mechanism 75 such that plates 77 are movable opposite toward and away from each other. Shaping plates 77 sandwich the portion of film 101 filled with the contents at a predetermined opposite interval to prevent a bulge of film 101, thereby smoothing the shape of the portion of film 101 that holds the contents. This can prevent variations in the volume of the contents. If the prevention of a bulge of film 1 is not particularly required such as when the contents are lightweight and when stringent demands are not present on the volume of the contents, shaping plates 17 are not necessary.

Next, the operation of abovementioned aseptic filling and packaging system 1 will be described.

One film 101 of two films 100 and 101 placed on film switching mechanism 20 is fed from film supply apparatus 2. Film 101 being fed is referred to as film 101 on the use side. The other film 100 is held at its leading end portion by heater bar receiver 33 and film holding member 34 of film fusion bonding mechanism 30. Film 100 being held is referred to as film 100 on the stand-by side.

Film 101 fed from film supply apparatus 2 passes through a predetermined traveling path and is supplied to sterilizing apparatus 5. Film 101 supplied to sterilizing apparatus 5 is sterilized by the hydrogen peroxide solution in sterilizing apparatus 5, dried by dry apparatus 6, and then supplied to filling and packaging machine 7.

Filling and packaging machine 7 shapes film 101 supplied thereto into a tube by vertical seal mechanism 73. The sterilized contents supplied from content supply apparatus 8 are introduced into film 101 shaped in the tube through supply pipe 72. Film 101 of tubular shape having the contents introduced therein is heat-sealed by horizontal seal mechanism 75 at regular space intervals in the longitudinal direction of film 101 to produce packages successively.

Through the successive production of packages, film 101 is continuously used. When whole film 101 is consumed, the operation of filling and packaging machine 7 should be stopped to set a new film before the operation is restarted. To address this, aseptic filling and packaging system 1 of the present embodiment automatically switches to the next film without stopping the operation of filling and packaging machine 7.

The switching operation of the films will hereinafter be described in detail.

When film 101 is used continuously and nears a trailing end portion, the film end tape appears. When the film end tape is detected by the film end sensor, the feeding of film 101 by feed rollers 3 is stopped. In this state, as shown in FIG. 5A, cutter unit 23 moves toward cutter receiver 24 to cut film 101 throughout the width thereof.

The feeding of film 101 by feed rollers 3 may be stopped immediately after the detection of the film end tape or may be stopped after a lapse of a predetermined time period. In any case, before the film end tape reaches between cutter unit 23 and cutter receiver 24, film 101 is preferably cut at the closest possible position to the film end tape in order to minimize a waste of film 101. The time period from the detection of the film end tape by the film end sensor to the operation of cutter unit 23 may be determined in accordance with the distance from the film end sensor to cutter receiver 24.

After film 101 is cut, cutter unit 23 is returned to the original position and film 101 is again fed by feed rollers 3. Although the feeding of the film by feed rollers 3 is stopped during the cutting operation of film 101, the filling and packaging operation is performed by filling and packaging machine 7 while film 101 stored in accumulation mechanism 40 is fed out.

With the feeding of the film by feed rollers 3, sucker 36 is driven to attract film 100 on the stand-by side held by film holding member 34 as shown in FIG. 5B.

After film 100 on the stand-by side is attracted, film 100 is released from the holding by film holding member 34 in this state and cylinder 39 is driven to move sucker 36 upstream in the film feeding direction. This returns film 100 upstream in the feeding direction thereof. The moving distance of sucker 36 is determined such that leading end portion 100*a* of film 100 is positioned in an area which can be pressurized by heater bar 31 and heater bar receiver 33 after the movement of sucker 36.

The release of film 100 on the stand-by side from film holding member 34 can be performed by moving film holding member 34 in a direction away from heater bar receiver 33. Alternatively, film 100 may be held by the self-weight of film holding member 34, and sucker 36 attracting film 100 may be moved to let out leading end portion 100*a* of film 100 from between film holding member 34 and heater bar receiver 33.

The position of leading end portion 100*a* of film 100 after the movement of sucker 36 is significantly important. Thus, film 100 is preferably held by film holding member 34 such that the beginning edge of film 100 is placed at a predetermined position determined on the basis of the moving distance of sucker 36.

For example, heater bar receiver 33 is provided with a mark representing the position of the beginning edge of film 100, and film 100 is held such that the mark coincides with the beginning edge of film 100. Alternatively, film 101 may be held such that the leading end portion of film 100 extends beyond an edge of film holding member 34 opposite to an edge closer to heater bar 31, and after the holding of film 101, the portion of film 100 extending beyond the edge of film holding member 34 may be cut, thereby determining the position of the beginning edge of film 100.

On the other hand, film 101 on the use side is further fed by feed rollers 3 (see FIG. 1). Film 101 on the use side is finally fed to the position where cut trailing end portion 101*a* thereof overlies leading end portion 100*a* of film 100 on the stand-by side in the area which can be pressurized by heater bar 31 and heater bar receiver 33. Since the distance from cutter unit 23 to heater bar 31 on the path of film 101 is previously known, the positioning of the trailing end portion of film 101 on the use side is relatively easy. After film 101 is fed to the abovementioned position, feed rollers 3 are stopped.

Once the leading end portion of film 100 on the stand-by side and the trailing end portion of film 101 on the use side are positioned at the abovementioned positions, heater bar 31 is moved forward toward heater bar receiver 33 as shown in FIG. 5D, and films 100 and 101 are pressurized and heated by heater bar 31 and heater bar receiver 33. This heat-seals the heated areas of films 100 and 101.

Then, as shown in FIG. 5E, heater bar 31 is returned to the original position to release films 100 and 101 from the pressurization state. This naturally cools and solidifies the heated areas of films 100 and 101, and consequently, film 101 on the use side and film 100 on the stand-by side are bonded in connection with each other. After the bonding of films 100 and 101, the driving of sucker 36 is stopped to release the holding of film 100 on the stand-by side.

As described above, in the present embodiment, film fusion bonding mechanism 30 includes sucker 36 which holds the part of film 100 on the stand-by side in the upper stream of the region held by film holding member 34, independently of film holding member 34. For the bonding of film 101 on the use side and film 100 on the stand-by side, sucker 36 pulls back film 100 such that leading end portion 100*a* of film 100 released from the holding by film holding member 34 is positioned in the area which can be pressurized by heater bar 31 while sucker 36 holds film 100 on the stand-by side.

As a result, as shown in FIG. 6, the whole overlap area of film 100 on the stand-by side and film 101 on the use side can be heat-sealed without forming any non-fused portion at the end portions of films 100 and 101. It is thus possible to prevent occurrence of any gap which leads to mixing of foreign matters or entry of the hydrogen peroxide solution.

Particularly in the aseptic filling and packaging system in which the film is immersed in the sterilizing liquid, if any gap is produced between the film on the use side and the film on the stand-by side, it is extremely difficult to avoid entry of the sterilizing liquid into the gap. Therefore, in the filling and packaging system in which the film on the use side and the film on the stand-by side can be heat-sealed without producing any gap therebetween, the possibility of the sterilizing liquid remaining in the package can be significantly reduced, and the system is especially suitable for application to an aseptic filling and packaging system.

After films 100 and 101 are bonded, feed rollers 3 (see FIG. 1) are driven again. This causes film 100 on the stand-by side to be fed following film 101 being used.

At substantially the same time as the driving of feed rollers 3, rotator 22 starts to rotate in the direction of the arrow as shown in FIG. 5F. The rotation of rotator 22 causes film 100 which was on the stand-by side to be guided by guide rollers 27. The remaining portion of film 101 which was on the use side stays held by film holder 22*a* at this point. FIG. 5F shows rotator 22 rotated 45 degrees with respect to the state shown in FIG. 5A.

As rotator 22 further rotates, film 100 starts to be guided also by guide rollers 25 attached to rotator 22 as shown in FIG. 5G. In the meantime, film 100 continues to be fed by feed rollers 3. FIG. 5G shows rotator 22 rotated 135 degrees with respect to the state shown in FIG. 5A.

As shown in FIG. 5H, the rotation movement of rotator 22 is stopped after it rotates 180 degrees with respect to the state shown in FIG. 5A. Since the rotation switches the relationship between two film holders 22*a* and 22*b*, film 100 which was on the stand-by side is now on the use side.

Film 101 which was on the use side is removed from film holder 22*b*, and a new film is placed on film holder 22*b* from which film 101 was removed. The new film is passed between drawing roller pairs 26 associated with film holder 22*b*, and a leading end portion thereof is held by film holding member 34 of film fusion bonding mechanism 30. The new film is now the stand-by film. The holding of the new film by film holding member 34 is performed while support member 32 is tilted as shown by the broken lines in FIG. 3. This can achieve the holding of the new film without interfering with the feeding of the film being used. After the leading end portion of the new film is held by film holding member 34, support member 32 is returned to the original position.

The abovementioned switching operation of the films is repeated every time the film needs to be replaced. As a result, filling and packaging machine 7 can be continuously operated without requiring a stop of the operation of filling and packaging machine 7 every time the film is replaced.

The present invention has been described with the representative embodiment taken as an example. However, the present invention is not in any way limited to the abovementioned embodiment.

For example, the abovementioned embodiment has shown the film returning mechanism which and attracts the film through vacuum sucking, but it is possible to use a clamp mechanism which sandwiches the film or a roller mechanism which rotates to feed the film back while pinching the film. The abovementioned embodiment has shown the film switching operation performed in response to the detection of the film end tape, but the film switching may be performed in response to detection of the trailing end of the film on the use side. In this case, the cutting mechanism is not necessary. However, if the trailing end of the film is detected, the cutting mechanism may be conveniently provided to allow switching of the film at an arbitrary portion of the film. In addition, the abovementioned embodiment has shown the aseptic filling and packaging system to which the present invention is applied, but the sterilizing apparatus and the dry apparatus are not required when aseptic filling is not needed such as when sterilization is performed at a step after the filling and packaging or when sterilization is not needed.

The invention claimed is:

1. A film supply apparatus comprising:

two film holders supporting two rolls of film as a film on a use side and a film on a stand-by side, respectively;

a feed roller for feeding the film on the use side;

a film holding member releasably holding a leading end portion of the film on the stand-by side in the upper stream of the feed roller in a feeding direction of the film such that the film on the stand-by side is drawn out to face the film on the use side;

a film returning mechanism having a pulling back member placed upstream of the film holding member in the feeding direction of the film and the pulling back member is moved upstream in the feeding direction of the film in a state in which the pulling back member holds the film on the stand-by side in the upper stream of the film holding member, whereby the pulling back member returns the film on the stand-by side upstream in the feeding direction thereof; and a fusion bonding mechanism placed between the film holding member and the pulling back member in the feeding direction of the film and heat-sealing the two opposite films throughout a width thereof.

2. The film supply apparatus according to claim 1, further comprising a cutter cutting the film on the use side along a width direction in the upper stream of the fusion bonding mechanism in the feeding direction of the film.

3. The film supply apparatus according to claim 1, wherein the film holders are supported by a rotator rotated 180 degrees to switch a relationship between the two film holders after the heat sealing of the film by the fusion bonding mechanism.

4. The film supply apparatus according to claim 1, wherein the fusion bonding mechanism has a heater bar containing an electric heater, and a heater bar receiver cooperating with the heater bar to pressurize and heat the film, and the heat sealing of the films on the use side and the stand-by side is performed by the heater bar and the heater bar receiver in a state in which the leading end portion of the film on the stand-by side released from the holding by the film holding member is pulled back by the film returning mechanism to be placed in an area pressurized by the heater bar and the heater bar receiver and a trailing end portion of the film on the use side is fed by the feed roller to overlie the film on the stand-by side in the area pressurized by the heater bar and the heater bar receiver.

5. The film supply apparatus according to claim 4, wherein the film holding member holds the leading end portion of the film by pressing the leading end portion of the film against the heater bar receiver.

6. The film supply apparatus according to claim 5, wherein the film holding member is attached to the heater bar receiver and the heater bar receiver is supported to be movable in a direction away from the heater bar.

7. The film supply apparatus according to claim 1, wherein the pulling back member has a sucker having a plurality of openings in a surface opposite to the film held by the film holding member and sucks air through the openings to attract the film.

8. The film supply apparatus according to claim 1, further comprising an accumulation mechanism placed downstream of the feed roller in the feeding direction of the film and changing a path length of the film.

9. A filling and packaging system comprising:

a film supply part including the film supply apparatus according to claim 1;

a content supply part supplying contents; and a filling and packaging part sealing the contents supplied from the content supply part into the film while the filling and packaging part shapes the film supplied from the film supply part into a bag.

10. The filling and packaging system according to claim 9, further comprising:

a sterilizing part sterilizing the film supplied from the film supply part by immersing the film in a sterilization liquid; and a dry part drying the sterilization liquid attaching to the film in the sterilizing part and supplying the film to the filling and packaging part.

11. A film supply apparatus comprising:

two film holders supporting two rolls of film as a film on a use side and a film on a stand-by side, respectively;

a feed roller for feeding the film on the use side;

a film holding member releasably holding a leading end portion of the film on the stand-by side in the upper stream of the feed roller in a feeding direction of the film such that the film on the stand-by side is drawn out to face the film on the use side;

a film returning mechanism placed upstream of the film holding member in the feeding direction of the film and pulling back the film on the stand-by side upstream in the feeding direction of the film in a state in which the film returning mechanism holds the film on the stand-by side in the upper stream of a part held by the film holding member; and a fusion bonding mechanism having a heater bar containing an electric heater and a heater bar receiver cooperating with the heater bar to pressurize and heat the film, the fusion bonding is placed between the film holding member and the film returning mechanism in the feeding direction of the film and heat-sealing the two opposite films throughout a width thereof, and wherein the heat sealing of the films on the use side and the stand-by side is performed by the heater bar and the heater bar receiver in a state in which the leading end portion of the film on the stand-by side released from the holding by the film holding member is pulled back by the film returning mechanism to be placed in an area pressurized by the heater bar and the heater bar receiver and a trailing end portion of the film on the use side is fed by the feed roller to overlie the film on the stand-by side in the area pressurized by the heater bar and the heater bar receiver, and the film holding member holds the leading end portion of the film by pressing the leading end portion of the film against the heater bar receiver.

12. The film supply apparatus according to claim 11, further comprising a cutter cutting the film on the use side along a width direction in the upper stream of the fusion bonding mechanism in the feeding direction of the film.

13. The film supply apparatus according to claim 11, wherein the film holders are supported by a rotator rotated 180 degrees to switch a relationship between the two film holders after the heat sealing of the film by the fusion bonding mechanism.

14. The film supply apparatus according to claim 11, wherein the film holding member is attached to the heater bar receiver and the heater bar receiver is supported to be movable in a direction away from the heater bar.

15. The film supply apparatus according to claim 11, wherein the film returning mechanism has a sucker having a plurality of openings in a surface opposite to the film held by the film holding means and sucks air through the openings to attract the film.

16. The film supply apparatus according to claim 11, further comprising an accumulation mechanism placed downstream of the feed roller in the feeding direction of the film and changing a path length of the film.

* * * * *